United States Patent [19]

Bailey et al.

[11] Patent Number: 4,646,826

[45] Date of Patent: Mar. 3, 1987

[54] WELL STRING CUTTING APPARATUS

[75] Inventors: Thomas F. Bailey; John E. Campbell; Nehal M. Shah, all of Houston, Tex.

[73] Assignee: A-Z International Tool Company, Houston, Tex.

[21] Appl. No.: 759,737

[22] Filed: Jul. 29, 1985

[51] Int. Cl.[4] ..... E21B 29/00

[52] U.S. Cl. ..... 166/55.3; 166/55.8; 175/286

[58] Field of Search ..... 166/55.3, 55.6, 55.7, 166/55.8, 54.5, 54.6, 297, 298; 175/273, 286

[56] References Cited

U.S. PATENT DOCUMENTS

| | | | |
|---|---|---|---|
| 2,859,943 | 11/1958 | Chadderdon | 166/55.8 |
| 2,940,522 | 6/1960 | Taylor et al. | 166/55.8 |
| 3,195,636 | 7/1965 | Cordary et al. | 166/55.8 |
| 3,331,439 | 7/1967 | Sanford | 166/55.8 |
| 4,550,781 | 11/1985 | Kagler, Jr. | 166/55.7 |

*Primary Examiner*—James A. Leppink
*Assistant Examiner*—Terry Lee Melius
*Attorney, Agent, or Firm*—Vinson & Elkins

[57] ABSTRACT

A well cutting tool for cutting casing in a well bore having a cutter body and at least one cutting arm pivotally mounted in a longitudinally extending slot of the cutter body. The cutting arm has removable and replaceable cutting inserts positioned along its outer front surface and its lower end surface. A removable and replaceable projection on the upper end of the cutter arm is provided for contact by a fluid pressure actuated piston for outward pivoting of the cutter arm into cutting position.

8 Claims, 5 Drawing Figures

WELL STRING CUTTING APPARATUS

BACKGROUND

The present invention relates to an apparatus for cutting a well casing.

Prior to the present invention, the apparatus used for cutting well strings or casing cutters comprised devices having cutting arms pivotally connected in longitudinal slots in the side of a tubular housing and having a suitable means therein for pivoting the arms outwardly. The upper surface and sometimes the outer end of the arms included material deposited thereon which would cut into casing when the tool is rotated within the casing. Thus, if sufficient force is applied to pivot the arms, they will cut through one or more casings so that they may be recovered as in the case of submarine wells which are being abandoned or to remove damaged casing from a well for replacement with new casing. A typical example of such apparatus is shown in U.S. Pat. No. 3,419,077.

With prior casing cutters, the arms need resurfacing to maintain them in proper condition for cutting. The deposit of the material on the arms is done with heat similar to a welding process and such deposit has a tendency to distort the arms making them unsuitable for reuse, and oftentimes causing cracks on the interface between the face material and the deposit. Resurfacing of the arms in a manner which makes them suitable for reuse is normally done only at a manufacturing facility. This is expensive and time consuming and requires that for each casing cutter, several spare arms be available at the wellhead for quick replacement.

Another disadvantage of the devices of the prior art is that some of them have required that the actuating device engage a surface on the arms to cause them to be urged outwardly. This surface is a cam surface and subject to severe wear in use, and when wear has progressed sufficiently far, the arm no longer would be used or repaired.

SUMMARY

The present invention relates to an improved well string cutting apparatus or well casing cutter. The apparatus includes a tubular housing with a central bore therethrough and a counterbore in the lower portion thereof and longitudinal slots through said housing, a pressure responsive means in said counterbore and having an extension, arms pivotally mounted in the upper end of each of said slots, a replaceable cutting surface on the outer surface of each of said arms, a removable projection on said arm which is engaged by an extension of the pressure responsive means so that downward movement of said pressure responsive means engages said removable projection and pivots said arms in the outward direction allowing cutting of casing surrounding the apparatus.

An object of the present invention is to provide an improved casing cutter which has greatly improved life in cutting casing in a well bore.

Another object is to provide an improved casing cutter which includes easy and quick replacement of components having a high degree of wear.

A further object is to provide an improved casing cutter which includes an arm with a replaceable surfacing of cutting material thereon which does not require heating of the arm for resurfacing.

Still another object is to provide an improved casing cutter which has a replaceable projection on the arm which takes the wear caused by the forces encountered in pivoting the arm during cutting.

Other objects, features, and advantages of this invention will become more apparent after referring to the following specification and drawings.

BRIEF DESCRIPTION OF THE DRAWINGS

These and other objects and advantages are hereinafter set forth and explained with reference to the drawings wherein.

DESCRIPTION OF THE PREFERRED EMBODIMENT

Figure 1:
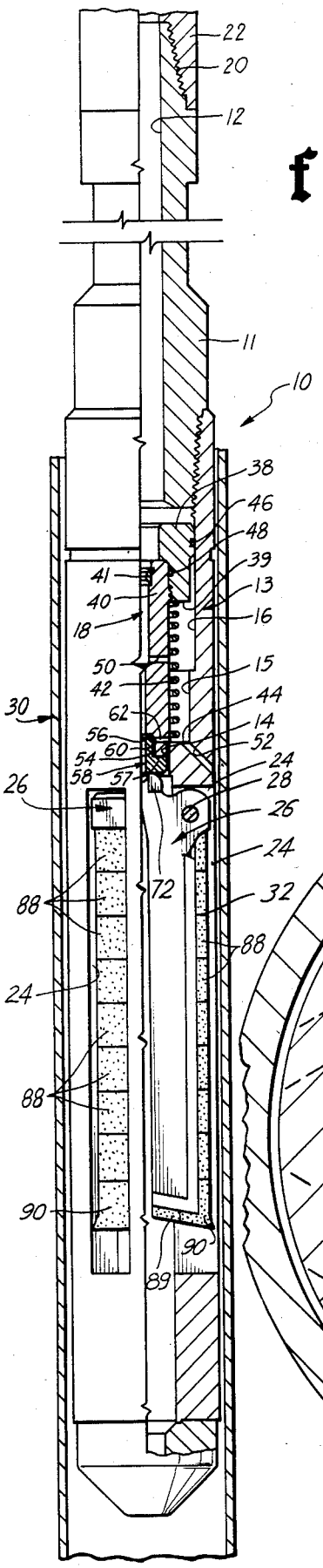
FIG. 1 is a sectional view of the improved casing cutter of the present invention positioned in a well casing with the casing cutter being shown partially in section.
Figure 5:
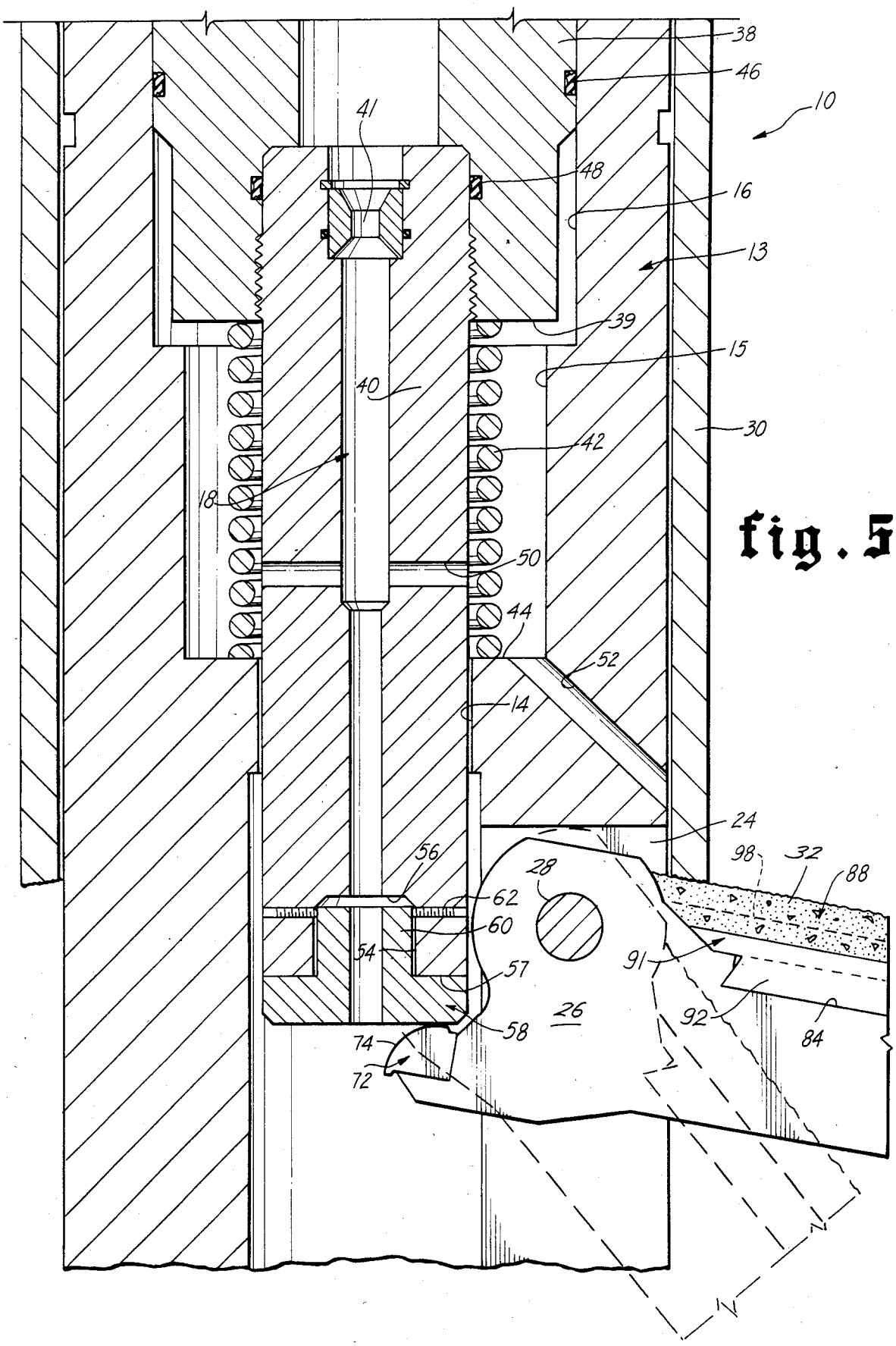
FIG. 5 is an enlarged sectional view similar to FIG. 2 but showing the pivoting of the arm to its outermost position in solid lines and to an intermediate position in dashed lines.

The improved well cutting apparatus or casing cutter comprising the present invention is generally indicated 10 and includes an upper sub 11 having a central bore 12 and threaded within the upper end of cutter body 13 which is tubular in shape. Cutter body 13 has a central bore defining a small diameter central 14, an intermediate diameter counterbore portion 15, and a large diameter upper counterbore portion 16 formed to receive pressure responsive means generally indicated 18 as hereinafter described. The upper end sub 11 is threaded at 20 to connect to well string 22. Three longitudinally extending slots 24 extend through cutter body 13 to receive elongate arms 26 of a generally rectangular cross section. An arm 26 is pivotally mounted at its upper end in each of slots 24 by a pin 28 so that arms 26 are free to be pivoted with their lower ends moving outward into cutting position as shown in FIG. 5. In FIG. 1, casing cutter 10 is shown in its running position with arms 26 positioned within slots 24 while casing cutter 10 is being lowered through casing 30 which is to be cut.

It is known that wells may have several concentric casing strings which are to be cut so the length of arms 26 and the degree of their pivotal movement is preselected so that all casing strings can be cut. The cutting is accomplished in a single trip by directing fluid under pressure through well string 22 and rotating well string 22 so that arms 26 are pivoted into engagement with casing 30 to be cut. Arms 26 include cutting surface 32 which engage and cut the casing. The connection between arms 26 and cutter body 13 is sufficient to transmit the torque necessary to accomplish cutting of the casing.

Pressure responsive means 18 includes an upper outer piston 38 having a lower annular face 39 and being slidably positioned in large diameter counterbore portion 16 of cutter body 13. An inner sleeve 40 is threaded onto piston 38 and extends downwardly therefrom with its lower end portion being received within small diameter bore 14 of cutter body 13. An orifice ring 41 fits within the upper end of sleeve 40 and the orifice formed thereby is sized to provide a restriction to the flow of fluid therethrough sufficient to actuate piston 38 against the force of a spring 42 compressed between lower face 39 of piston 38 and abutment 44 formed by intermediate diameter bore portion 15. Piston 38 is movable between an upper position shown in FIGS. 1 and 2 and a lower cutting position shown in FIG. 5. Elastomeric sealing rings 46 and 48 extend about the respective outer and inner peripheries of piston 38. Ports 50 extend through sleeve 40 and ports 52 extend through cutter body 13 to permit the flow of fluid therethrough.

The lower end of piston sleeve 40 is recessed at 54 to form annular shoulder 56. Fitting around the lower end 57 of sleeve 40 is a wear ring generally indicated at 58 and having an inner flange 60 fitting within the recessed portion 54 of sleeve 40. Suitable set screws 62 threaded within sleeve 40 engage flange 60 to hold wear ring 58 in desired position for engaging the upper ends of arms 26 as will be explained.

Arm 26 includes a removable projection or tang 72 at its upper end which has a curved camming surface 74 engaged by the lower surface of wear ring 58 at a location offset inwardly from pivot pin 28 for the outward pivoting of the lower end of arm 26 to cutting position. Tang 72 includes body 76 and stem 78 which is positioned in bore 80 in arm 26 and is secured therein by locking screw 82. Tang 72 is positioned to receive the force of piston 38 and wear ring 58, and translate such force into the pivoting of arm 26 while maintaining sufficient force on arm 26 to cut through casing 30.

Figure 3:
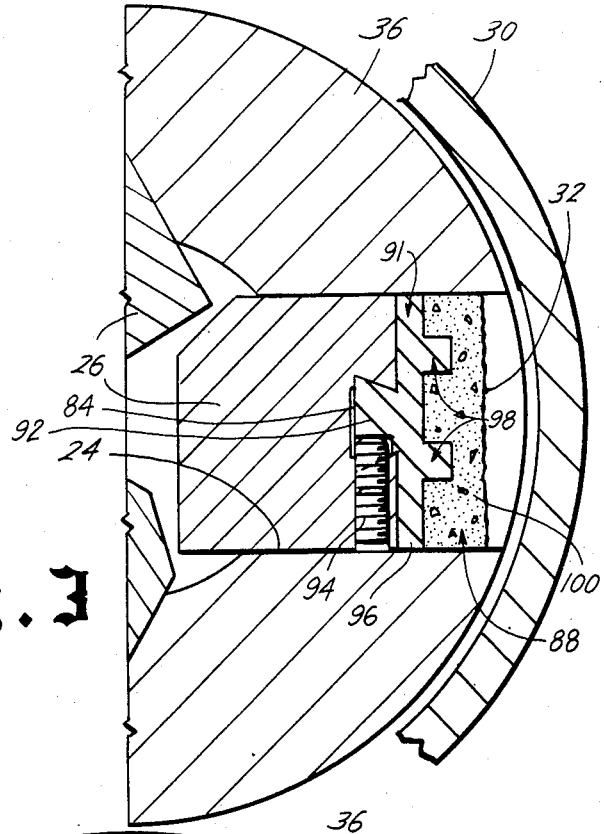
FIG. 3 is a sectional view taken along line 3—3 in FIG. 2.
Figure 4:
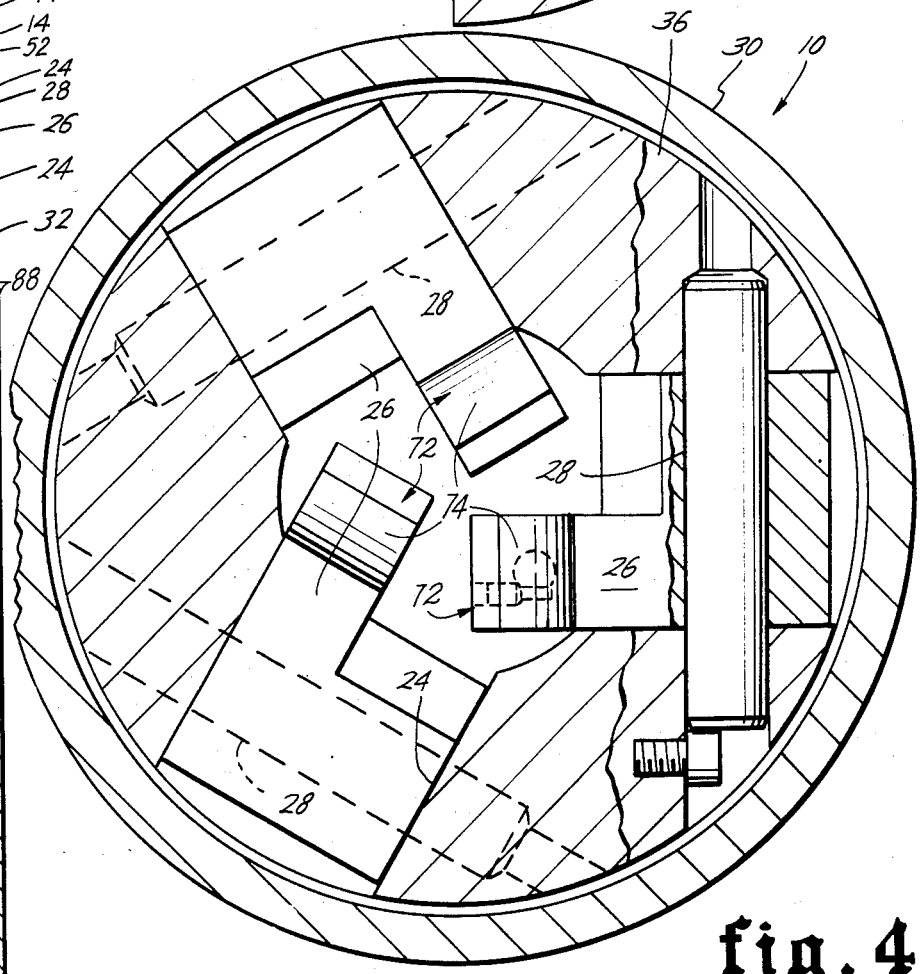
FIG. 4 is a sectional view taken along line 4—4 in FIG. 2.
Figure 2:
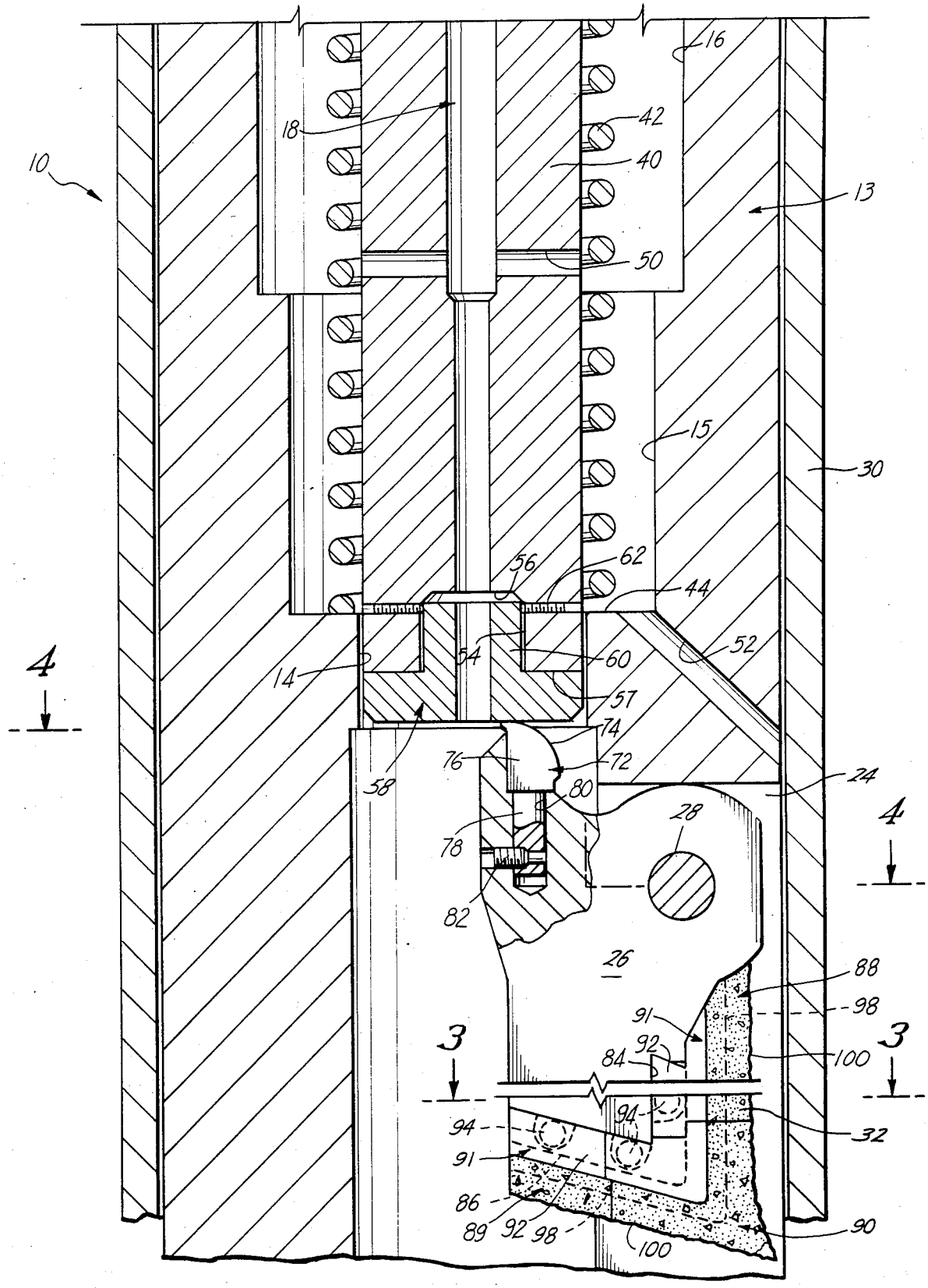
FIG. 2 is an enlarged detailed sectional view of the replaceable components on the arm in the improved casing cutter of the present invention.

Arm 26, as best seen in FIGS. 2, 3, and 4, has a dovetail groove 84 along its outer front face or surface and dovetail groove 86 along its lower end surface. Fitting within dovetail grooves 84 and 86 are a plurality of side and end cutting inserts 88 and 89, respectively. A corner cutting insert 90 is provided at the juncture of grooves 84 and 86 and is received within end dovetail groove 86 as indicated in FIG. 2. Each cutting insert 88, 89 and 90 has a metallic base 91 with a dovetail projection 92 on a rear face which fits in groove 84 or 86 and is secured therein by locking screws 94 as seen in FIG. 3, which is a typical section through arm 26 and cutting inserts 88, 89 and 90.

Inserts 88, 89 and 90 each has ribs 98 on the front face of base 91. Cutting material 100 is deposited on the front face of base 91 including ribs 98 which aid in securing material 100 onto the front face of base 91. Replacement of individual inserts 88, 89 and 90, such as might be desirable after a predetermined amount of wear of cutting material 100, is relatively simple and is accomplished upon removal of cutter 10 from the well. For example, if it is desired to replace an insert 88 intermediate the length of arm 26, corner insert 90 is first removed by loosening the associated locking screw 94, and then inserts 88 are removed in sequence from the lower end of groove 84 until the insert 88 desired to be replaced is removed. Then, a new insert 88 is inserted at the lower end of groove 84 along with the remaining previously removed inserts 88, 90 and locking screws 94 are tightened.

Thus, it is apparent that an improved cutting arm 26 has been provided for a casing cutter including easily removable wear inserts 88, 89 and 90 on the lower end and front faces of the arms. Replacement of such inserts having a wear surface 32 formed by cutting material 100 for cutting contact with the casing 30 is accomplished in a minimum of time. Also, an easily removable projection 72 is provided on arm 26 for replacement as needed.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A well cutting tool for cutting well casing comprising:

a tubular cutter body having a longitudinally extending slot therein and adapted to be connected to a well string for being lowered into a well;

an elongate cutter arm received within said slot and having a cutting surface adjacent its lower end;

means on the cutter body for pivotally securing the upper end of said cutter arm in said slot to permit the outward pivoting of the lower end of the arm into cutting contact with the casing;

a piston in said cutter body movable longitudinally of said cutter body in response to fluid pressure in said well string, means continuously urging the piston in an upward direction;

a replaceable projection on said cutter arm having an end with a rounded surface thereon in a position to be engaged by said piston upon downward movement thereof in response to an increase in fluid pressure in the well string thereby to cause the lower end of said arm to pivot outwardly into cutting position with said well casing, said projection having a stem extending from said end, said arm having a recess into which said stem is received; and means for removably securing said projection within said recess thereby to permit said projection to be easily replaced.

2. A well cutting tool as set forth in claim 1 wherein said cutter arm has a removable cutting insert adjacent its lower end, said cutting insert having a base removably secured to said arm and a cutting material secured to the base along an outer surface thereof for contacting the casing in cutting relation.

3. A well cutting tool for cutting well casing comprising:

a tubular cutter body having a longitudinally extending slot therein and adapted to be connected to a well string for being lowered within the well casing;

an elongate cutter arm received within said slot and having a cutting surface adjacent its lower end;

means on the cutter body for pivotally securing the upper end of said cutter arm in said slot to permit the outward pivoting of the lower end of the arm into cutting contact with the casing;

means to contact said cutter arm under a predetermined condition to move the lower end of said arm radially outwardly into cutting contact with the casing;

a plurality of replaceable cutting inserts in longitudinally aligned relation along the outer front surface of said elongate cutter arms forming a continuous cutting surface; and means removably mounting each of said plurality of cutting inserts on said outer front surface of said elongate arm to permit individual replacement of said cutting inserts.

4. A well cutting tool as set forth in claim 3 wherein each of said replaceable cutting inserts comprises a base removably secured to said arm and a cutting material along an outer surface of the base for contacting the casing in cutting relation.

5. A well cutting tool as set forth in claim 4 wherein said arm and said base have an interfitting dovetail groove and projection for removably securing the inserts on the arm.

6. A well cutting tool for cutting well casing comprising:

a tubular cutter body having a longitudinally extending slot therein and adapted to be connected to a well string for being lowered within the well casing;

an elongate cutter arm received within said slot and having a cutting surface adjacent its lower end;

means on the cutter body for pivotally securing the upper end of said cutter arm in said slot to permit the outward pivoting of the lower end of the arm into cutting contact with the casing;

means to contact said cutting arm under a predetermined condition to move the lower end of said arm radially outwardly into cutting contact with the inner periphery of the casing;

a plurality of replaceable cutting inserts arranged in longitudinally aligned sections along the outer front surface of said elongate cutter arm to form a continuous elongate surface, each insert having a base removably secured to said arm and a cutting material along an outer surface of the base for contacting the casing in cutting relation; and means for releasably securing said base on said arm, and permitting selective replacement of individual cutting inserts on said arm.

7. A well cutting tool as set forth in claim 6 wherein said arm and said base have an interfitting dovetail connection and a locking screw releasably securing said base to said arm at said dovetail connection.

8. A well cutting tool as set forth in claim 6 wherein a removable corner insert extending along the lower end surface of said arm is positioned at the lower end of said arm.

* * * * *